US005187410A

United States Patent [19]

Shimizu et al.

[11] Patent Number: 5,187,410

[45] Date of Patent: Feb. 16, 1993

[54] ELECTRONIC FLASH DEVICE

[75] Inventors: Kazuyuki Shimizu, Tokyo; Satoshi Harada; Masazi Yoshimura, both of Hachioji, all of Japan

[73] Assignee: Konica Corporation, Tokyo, Japan

[21] Appl. No.: 868,523

[22] Filed: Apr. 15, 1992

[30] Foreign Application Priority Data

Apr. 18, 1991 [JP] Japan ..... 3-113988
Apr. 18, 1991 [JP] Japan ..... 3-113989

[51] Int. Cl.[5] ..... H05B 41/30
[52] U.S. Cl. ..... 315/241 P; 315/DIG. 7
[58] Field of Search ..... 315/209 CD, 219, 239, 315/241 P, 276, 289, 290, DIG. 7

[56] References Cited

U.S. PATENT DOCUMENTS 5,140,201 8/1992 Uenishi ..... 307/571

FOREIGN PATENT DOCUMENTS 1-17033 1/1989 Japan .

*Primary Examiner*—David Mis
*Attorney, Agent, or Firm*—Finnegan, Henderson, Farabow, Garrett and Dunner

[57] ABSTRACT

An electronic flash device includes a flash discharge tube, an IGBT, connected to the flash discharge tube, for controlling light emission, a trigger means for driving the flash discharge tube, an AC voltage generating means having an oscillation transformer for generating an AC voltage from an input voltage, and a power supply section for generating a gate drive voltage for the IGBT from a counter electromotive voltage generated at a terminal of a winding of the oscillation transformer. The electronic flash device further includes an IGBT drive voltage generating means, a first resistor connected between the IGBT drive voltage generating means and a gate of the IGBT, a capacitor having a terminal connected to the IGBT drive voltage generating means and having a capacitance larger than an electrostatic capacitance across the gate and an emitter of the IGBT, a second resistor having a terminal connected to the other terminal of the capacitor and the other terminal connected to the gate of the IGBT and a resistance smaller than that of the first resistor, and a third resistor connected between a ground terminal and a connection terminal between the IGBT drive voltage generating means and the first resistor.

3 Claims, 6 Drawing Sheets

ELECTRONIC FLASH DEVICE

BACKGROUND OF THE INVENTION

1. Field of the Invention

The present invention relates to an electronic flash device used for flash photography by a camera.

2. Description of the Prior Art

An automatic light control electronic flash device used recently in flash photography by a camera employs a thyristor or an FET for ON/OFF-controlling a flash discharge tube. It is known that in a device employing a thyristor, even if control is performed to turn off the flash discharge tube, the OFF timing of the flash discharge tube is delayed, resulting in an excessive quantity of emitted flash light. In a device employing an FET, a large FET element is needed to cope with a large current upon emission of light of the flash discharge tube, resulting in an increase in size of the entire device. For these reasons, Japanese Patent Laid-Open No. 64-17033 proposes an automatic light control flash device which uses a relatively small IGBT (Insulated Gate Bipolar Transistor; described in detail in "Nikkei Electronics", May 19, 1986, No. 395, pp. 182–185) that can perform switching of a large current for turning on/off a flash discharge tube. When an IGBT is used, the flash discharge tube is connected to a main capacitor charged with a DC voltage of, e.g., 280 V, and the cathode of the flash discharge tube is connected to the collector of the IGBT. A light-emitting drive voltage of, e.g., 30 V is applied to the gate of the IGBT to turn on the IGBT, and simultaneously the flash discharge tube emits light when it is triggered in a known manner. When supply of the light-emitting drive voltage to the gate of the IGBT is discontinued, the collector-emitter path of the IGBT is disconnected (OFF), and light emission by the flash discharge tube is stopped. Control of flash light emission is performed by switching the IGBT in this manner.

In this case, in order to obtain the DC voltages of 30 V and 280 V from a power supply cell of a DC voltage of, e.g., 6 V, a known DC-DC converter is generally used, and an AC voltage induced in the secondary winding of the oscillation transformer of the DC-DC converter is rectified.

The conventional device using the IGBT has the following problems.

(1) The AC voltage induced in the secondary winding of the oscillation transformer is rectified to obtain the DC voltage of 30 V as the gate drive voltage to the IGBT. In this case, the AC voltage cannot be efficiently obtained in the secondary winding of the transformer by induction (M), and the size of the oscillation transformer is increased by the capacity of the secondary winding.

(2) For example, a square-wave voltage as shown in FIG. 6(*a*) is supplied to the gate of the IGBT. However, due to the electrostatic capacitance and the like of the gate-emitter path of the IGBT, the ON (connection)/-OFF (disconnection) timings of the collector-emitter path of the IGBT with respect to the rise and fall of the square-wave voltage are delayed, as shown in FIG. 6(*b*), and the quantity of emitted flash light becomes as shown in FIG. 6(*c*). In this manner, while the quantity of the emitted flash light is controlled by the ON/OFF operation of the IGBT, since the electrostatic capacitances vary depending on individual IGBTs or other conditions, it is difficult to obtain a desired quantity of emitted light with a uniform light-emitting control signal.

SUMMARY OF THE INVENTION

The present invention has been made in view of the above problems, and has as its object to provide a simple, excellent electronic flash device which has a small oscillation transformer and can stably control an IGBT by obtaining a gate drive voltage to the IGBT from a counter electromotive voltage generated at a terminal of the primary winding of an oscillation transformer when an DC-DC converter and the IGBT for controlling a flash discharge tube are to be utilized.

It is another object of the present invention to provide an excellent electronic flash device having improved control characteristics of the emitted flash light of a flash discharge tube without delaying the ON/OFF timings of an IGBT.

According to an aspect of the present invention, there is provided an electronic flash device comprising: a flash discharge tube; an IGBT, connected to the flash discharge tube, for controlling light emission; trigger means for driving the flash discharge tube; AC voltage generating means having an oscillation transformer for generating an AC voltage from an input voltage; and a power supply section for generating a gate drive voltage for the IGBT from a counter electromotive voltage generated at a terminal of a winding of the oscillation transformer.

According to another aspect of the present invention, there is provided an electronic flash device comprising: a flash discharge tube; an IGBT, connected to the flash discharge tube, for controlling light emission; trigger means, connected to the flash discharge tube, for performing light emission; trigger means for driving the flash discharge tube; IGBT drive voltage generating means for generating the drive voltage for the IGBT; a first resistor connected between the IGBT drive voltage generating means and a gate of the IGBT; a capacitor having a terminal connected to the IGBT drive voltage generating means and having a capacitance larger than an electrostatic capacitance across the gate and an emitter of the IGBT; a second resistor having a terminal connected to the other terminal of the capacitor and the other terminal connected to the gate of the IGBT and a resistance smaller than that of the first resistor; and a third resistor connected between a ground terminal and a connection terminal between the IGBT drive voltage generating means and the first resistor.

DETAILED DESCRIPTION OF THE PREFERRED EMBODIMENTS

The present invention will be described with reference to the accompanying drawings.

According to an electronic flash device of the present invention, a gate drive voltage to an IGBT, connected to a flash discharge tube, for controlling light emission, is generated by rectifying the counter electromotive voltage at a terminal of the primary winding of an oscillation transformer, i.e., an oscillation transformer of a DC-DC converter which generates an AC voltage from an input DC voltage and by charging a capacitor. The charged voltage is applied to the gate of the IGBT through, e.g., a switching transistor, thus switching the IGBT for flash light emission.

Since the voltage to be charged in the capacitor is obtained by rectifying the counter electromotive voltage at the terminals of the primary winding, it can be charged faster than, e.g., a voltage to be charged in a main capacitor for light emission by the flash discharge tube which is charged by an AC voltage generated by a secondary winding. Thus, the arrangement is simplified, the oscillation transformer is made small in size, and the IGBT can be stably controlled.

An electronic flash device according to the first embodiment of the present invention will be described in detail with reference to the accompanying drawings.

Figure 1:
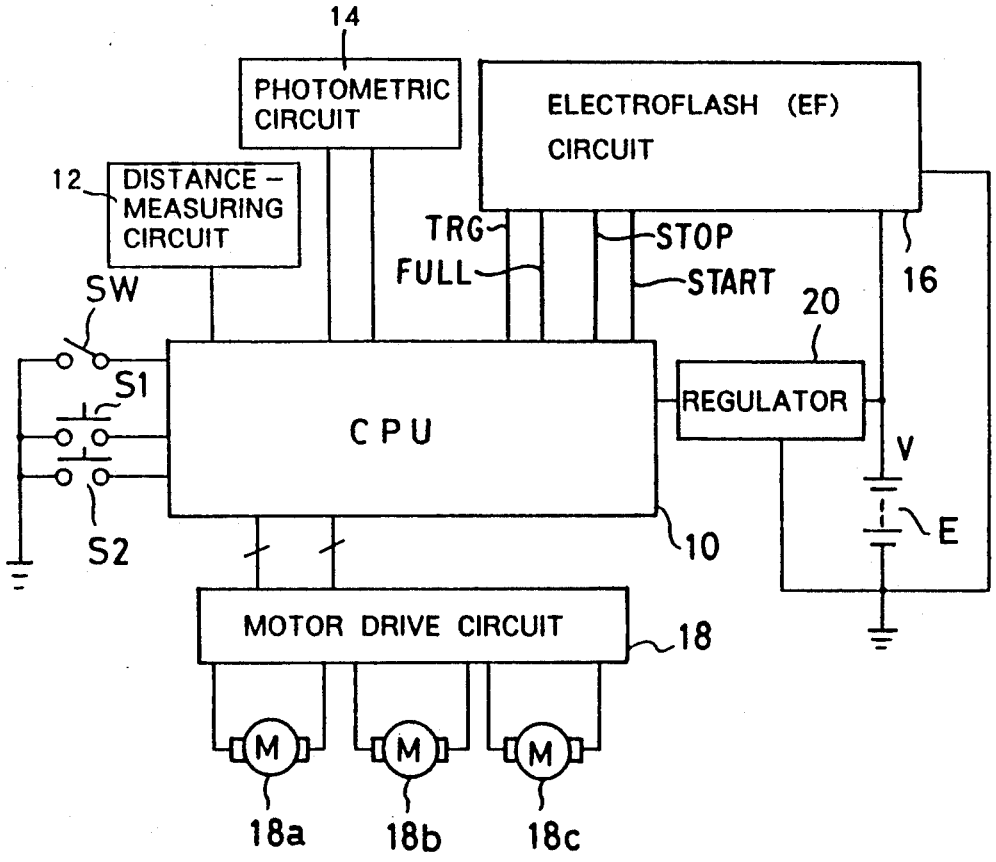
FIG. 1 is a block diagram showing the electrical arrangement of a camera to which an electronic flash device according to the first embodiment of the present invention is applied.

FIG. 1 is a block diagram showing the electrical arrangement of a camera to which the electronic flash device according to the first embodiment of the present invention will be applied.

The camera of FIG. 1 has a CPU 10 having a known working RAM for controlling the entire device, a ROM storing a program, an I/0, and the like. The CPU 10 is connected to a known distance-measuring circuit 12 for detecting a distance to an object, a photometric circuit 14 for detecting a quantity of light from the object and the like, and an electroflash (EF) circuit 16 serving as an electronic flash device according to the first embodiment of the present invention. The CPU 10 and the EF circuit 16 are connected to each other via a trigger line TRG, a main capacitor charge completion detection line FULL, an oscillation stop line STOP, and an oscillation start line START. Detection signals from the distance-measuring circuit 12 and the photometric circuit 14, respectively, are supplied to the CPU 10, and control signals based on the values of these detection signals are supplied to a motor drive circuit 18. The motor drive circuit 18 is connected to, e.g., a lens driving motor 18*a*, a shutter driving motor 18*b*, a film winding motor 18*c*, and the like.

The CPU 10 has a barrier (lens cover) switch SW, a switch S1 for causing charge and the like for distance measurement, a photometric operation, and flash light emission which are performed prior to a photographic operation, and a switch S2 for causing the EF circuit 16 to perform photographic operations including pre-charge, a shutter release, and film winding.

The EF circuit 16 is connected to a cell E, serving as a power supply of flash light emission, for applying a voltage V, and a three-terminal regulator 20 for supplying a stable voltage from the cell E to the CPU 10.

Figure 2:
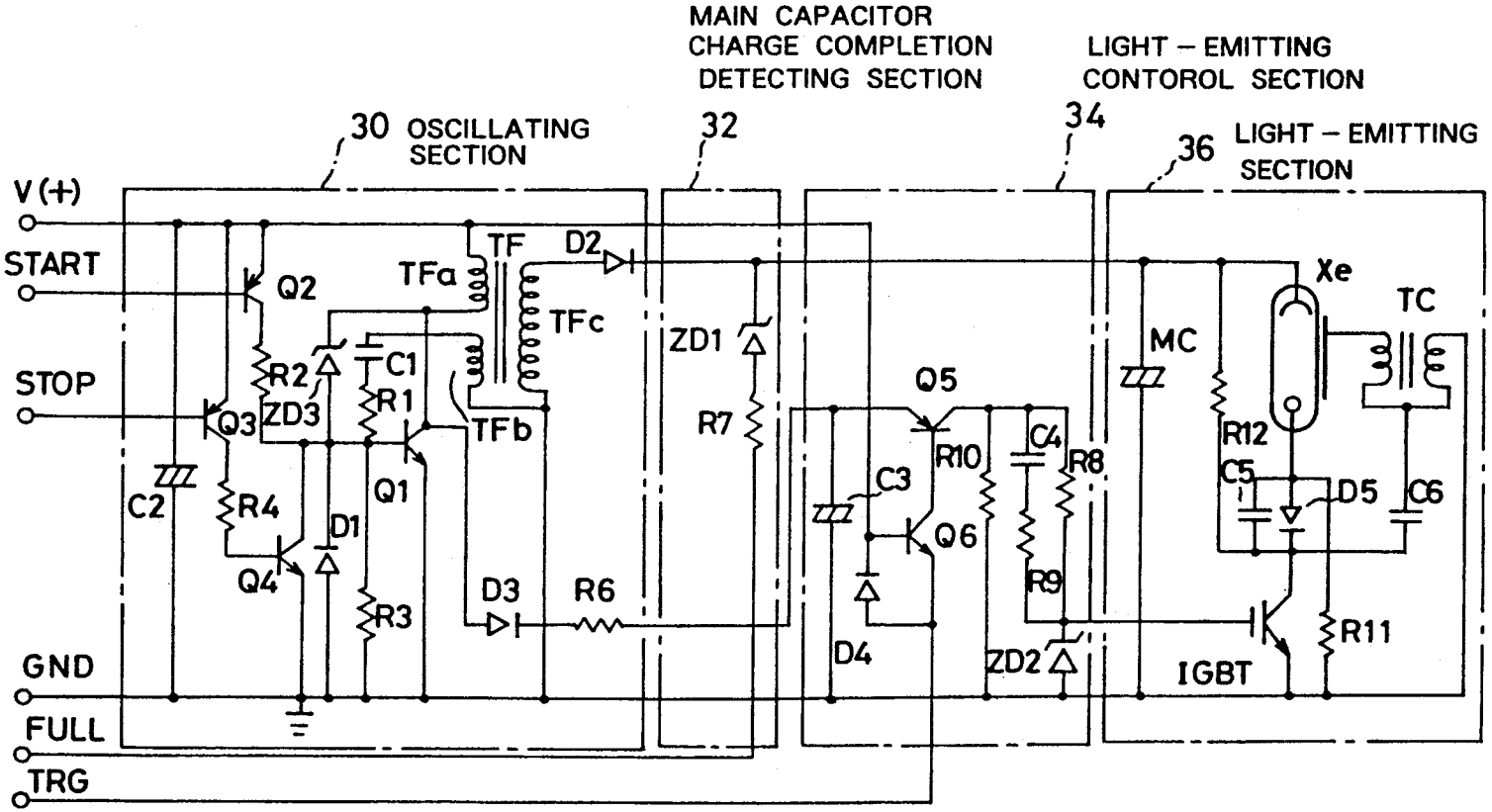
FIG. 2 is a circuit diagram showing the arrangement of an EF circuit of FIG. 1 in detail.

FIG. 2 is a circuit diagram showing in detail the arrangement of the EF circuit 16 of FIG. 1.

The EF circuit 16 is roughly constituted by an oscillating section 30, a main capacitor charge completion detecting section 32, a light-emitting control section 34, and a light-emitting section 36. The oscillating section 30 obtains a high voltage from the voltage E of the cell E. The detecting section 32 sends a detection signal representing that charge of the main capacitor is completed to the CPU 10 through the detection line FULL. The light-emitting control section 34 is connected to the CPU 10 via the trigger line TRG to perform light-emitting control. The light-emitting section 36 emits flash light by being controlled by the light-emitting control section 34.

The oscillating section 30 is a known ringing choke converter (RCC; self-excited DC-DC converter) mainly constituted by an oscillating transistor Q1 and an oscillation transformer TF. The oscillation transformer TF has primary, auxiliary, and secondary windings TFa, TFb, and TFc. One terminal of the primary winding TFa is connected to a voltage line V, and its other terminal is connected to the collector of the oscillating transistor Q1. A Zener diode ZD3 is connected between the other terminal of the primary winding TFa and the base of the oscillating transistor Q1. A feedback capacitor C1 for setting an oscillation output and a resistor R1 are connected in series between one terminal of the auxiliary winding TFb and the base of the oscillating transistor Q1. The other terminal of the auxiliary winding TFb is grounded. A feedback diode D1 and a resistor R3 for stabilizing oscillation are connected between the base of the oscillating transistor Q1 and a ground terminal GND.

The oscillating section 30 also has an oscillation start transistor Q2. The base of the transistor Q2 is connected to the oscillation start line START, its emitter is connected to the voltage line V, and its collector is connected to the base of the oscillating transistor Q1 through a resistor R2.

The oscillating section 30 also has an oscillation stop transistor Q3. The base of the transistor Q3 is connected to the oscillation stop line STOP, and its emitter is connected to the voltage line V. The collector of the transistor Q3 is connected to the base of an oscillation stop switching transistor Q4 through a resistor R4. The emitter of the transistor Q4 is grounded, and its collector is connected to the base of the oscillating transistor Q1.

One terminal of the oscillation transformer TFc is connected to a rectifying diode D2 for generating a power supply (voltage) for flash light emission to obtain, e.g., a DC voltage of 280 V. The other terminal of the oscillation transformer TFc is grounded. The collector of the oscillating transistor Q1, i.e., the counter electromotive voltage generating terminal of the primary winding TFa is connected to a rectifying diode D3, and a filtering resistor R6 is connected in series with the diode D3. The gate drive voltage to the IGBT to be described later, e.g., a DC voltage of 30 V is obtained by the filtering resistor R6.

An electrolytic capacitor C2 for a power supply filter is connected between the voltage line V and the ground terminal GND.

In the main capacitor charge completion detecting section 32, a Zener diode ZD1 as a high-voltage reference and a protecting/filtering resistor R7 are connected in series with the cathode of the rectifying diode D2. The Zener diode ZD1 is turned on upon detection of a voltage of, e.g., 280 V when charge of a main capacitor MC to be described later is completed. The filter R7 supplies a detection signal representing that charge is completed to the CPU 10 and to an amplifying circuit (not shown) through the detection line FULL. An LED or the like serving as a load is provided in the amplifying circuit and is turned on to indicate completion of charge.

The light-emitting control section 34 has an electrolytic capacitor C3 which is charged with a voltage from the filtering resistor R6, i.e., the gate drive voltage to the IGBT, e.g., a DC voltage of 30 V, and a switching transistor Q5 for turning on/off this gate drive voltage to the gate of the IGBT. The emitter of the switching transistor Q5 is connected to the electrolytic capacitor C3, and its base is connected to the collector of a switching transistor Q6. The base of the switching transistor Q6 is connected to the voltage line V, and its emitter is connected to the trigger line TRG. When the trigger line TRG is turned on, i.e., is grounded, the voltage charged in the electrolytic capacitor C3 is output through the collector of the switching transistor Q5 as the gate drive voltage to the IGBT. A diode D4 is connected between the base and emitter of the switching transistor Q6.

A power supply resistor R8 is connected between the collector of the switching transistor Q5 and the gate of the IGBT, and a capacitor C4 and a resistor R9 are also connected in series between the collector of the transistor Q5 and the gate of the IGBT. The two terminals of the capacitor C4 and the resistor R9 are connected to the two terminals of the power supply resistor R8, i.e., between the collector of the switching transistor Q5 and the gate of the IGBT. The resistance of the resistor R9 is set to be lower than that of the resistor R8 so that the resistor R9 performs an operation to be described later in detail, and the electrostatic capacitance of the capacitor C4 is set to be larger than the capacitance across the gate and emitter of the IGBT. A resistor R10 is connected between the collector of the switching transistor Q5 and the ground terminal GND. A Zener diode ZD2 for gate voltage clamping of the IGBT is connected between the ground terminal GND and a connection terminal between the resistors R8 and R9, i.e., the gate of the IGBT.

In the light-emitting section 36, the main capacitor MC, which is charged with an output voltage from the rectifying diode D2 of the oscillating section 30 in order to serve as the power supply for flash light emission, is connected between the cathode of the diode D2 and the ground terminal GND.

The positive terminal of the main capacitor is connected to the anode of a known flash discharge tube Xe. The cathode of the flash discharge tube Xe is connected to one terminal of a parallel circuit of a capacitor C5 for applying a counter bias and a diode D5. The other terminal of the parallel circuit of the capacitor C5 and the diode D5 is connected to the collector of the IGBT. The emitter of the IGBT is grounded, and its gate is connected to the Zener diode ZD2 of the light-emitting control section 34.

A trigger capacitor C6 is connected between the collector of the IGBT and a trigger transformer TC. One terminal of the trigger transformer TC is connected to the trigger electrode of the flash discharge tube Xe, and its other terminal is grounded. The cathode of the flash discharge tube Xe is connected to one terminal of each of the capacitor C5, a resistor R11 for charging the trigger capacitor C6, and the diode D5. The other terminal of each of the capacitor C5 and the diode D5 is connected to the collector of the IGBT, and the other terminal of the resistor R11 is grounded. One terminal of a charge resistor R12 is connected to the other terminal of the diode D5, and its other terminal is connected to the anode of the flash discharge tube Xe.

The operation of the electronic flash device according to the present invention described above will be described.

When the barrier switch SW is turned on and subsequently the switch S1 is turned, the oscillation start line START is grounded by control of the CPU 10. Then, a voltage is applied to the base of the oscillating transistor Q1 to enable the oscillating section 30. An AC voltage induced in the secondary winding TFc of the oscillation transformer TF is rectified by the rectifying diode D2, and an output (ripple current) from the diode D2 is started to be charged in the main capacitor MC.

At the same time, a voltage at the collector of the oscillating transistor Q1, i.e., the voltage at the counter electromotive voltage-generating terminal of the primary winding TFa of the oscillation transformer TF is rectified by the rectifying diode D3 to be input to the filtering resistor R6, and an output DC voltage from the resistor R6 is charged in the electrolytic capacitor C3. The charged DC voltage is utilized as the drive voltage to the IGBT.

When charge of the main capacitor MC is completed, a detection signal is supplied to the CPU 10 and the amplifying circuit (not shown) via the detection line FULL which is connected to the protecting/filtering resistor R7 of the detecting section 32 to turn on the LED or the like, thus indicating that charge is completed, i.e., flash light emission can be performed.

When the charge is completed, the oscillation stop line STOP is enabled, i.e., is grounded to turn on the oscillation stop transistor Q3. Subsequently, the oscillating stop switching transistor Q4 is turned on to ground the base of the oscillating transistor Q1. The operation of the oscillating section 30 is thus stopped.

Figure 3:
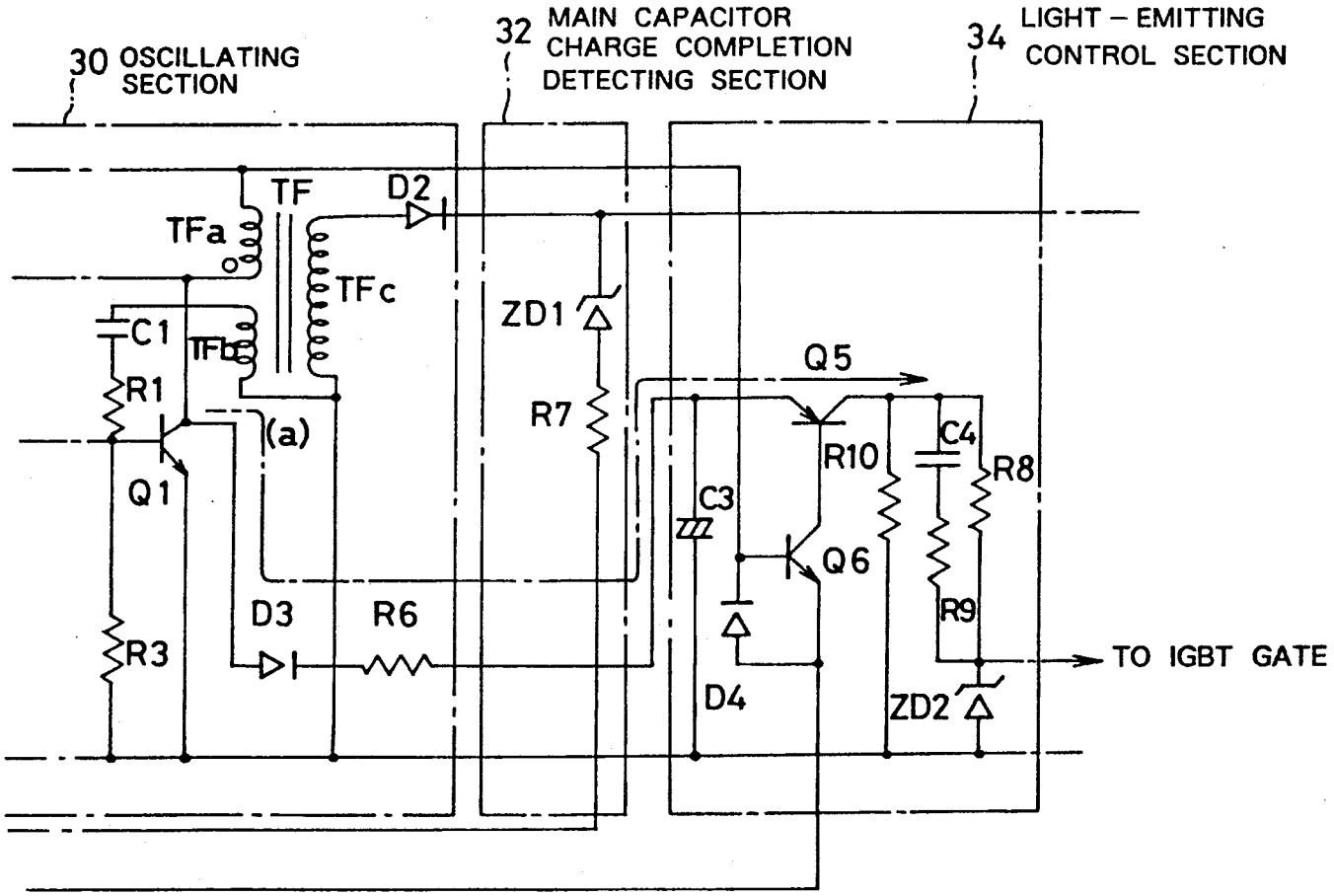
FIG. 3 is a circuit diagram for explaining the operations of an oscillating section and a light-emitting control section of the electronic flash device according to the first embodiment of the present invention when a gate drive voltage is to be obtained.

When the switch S2 is turned on successively after the switch S1 is turned on, i.e., when the trigger line TRG is grounded, the switching transistor Q6 is turned on, and subsequently the switching transistor Q5 is turned on. Then, the voltage charged in the electrolytic capacitor C3 is output through the collector of the switching transistor Q5. This output is first supplied to the gate of the IGBT through the capacitor C4 and the resistor R9. When charge of the capacitor C4 is completed, the voltage is supplied to the gate of the IGBT through the power supply resistor R8. Thus, the IGBT is turned on, a high voltage is supplied to the trigger electrode of the flash discharge tube Xe simultaneously, and the flash discharge tube Xe starts flash light emission upon reception of the voltage charged in the main capacitor MC. FIG. 3 is a circuit diagram for explaining the operation of the oscillating section 30 and the light-emitting control section 34 when the gate drive voltage is to be obtained. The flow of current during the operation is indicated by an alternate long and short dashed line (a) in FIG. 3.

As shown in FIG. 3, the gate drive voltage for the IGBT needed when the flash discharge tube Xe emits flash light is obtained by rectifying the voltage at the collector of the oscillating transistor Q1, i.e., the voltage at the counter electromotive voltage-generating terminal of the primary winding TFa by the rectifying diode D3 connected to the counter electromotive voltage-generating terminal, and supplying the rectified voltage to the filtering resistor R6 and charging the rectified voltage in the electrolytic capacitor C3. The voltage charged in the electrolytic capacitor C3 is supplied to the light-emitting section 36 as the gate drive voltage for the IGBT for flash light emission through the light-emitting control section 34. In this case, since the counter electromotive voltage at the primary winding TFa of the oscillation transformer TF is utilized as the gate drive voltage for the IGBT, a secondary winding for the gate drive voltage of the IGBT is not needed. As a result, the size of the oscillation transformer TF is reduced by the capacity of the secondary winding, and the size and weight of a camera which incorporates this device are reduced.

Since the gate drive voltage for the IGBT is not obtained from the secondary winding of the oscillation transformer TF, the electrolytic capacitor C3 can be charged faster than the main capacitor MC. Hence, a required gate drive voltage for the IGBT, e.g., a rated voltage of 30 V can be obtained faster than charging the main capacitor MC, and an accident to damage an element by switching the IGBT by a gate drive voltage lower than the rated voltage of 30 V can be prevented.

Since the needed gate drive voltage for the IGBT of the rated voltage can be obtained faster, a photographic operation can be performed before completion of charge of the main capacitor MC, i.e., a shutter chance will not be missed. A time lag in flash control operation of a camera is shortened, and the degree of freedom in design of the camera is increased.

Since the voltage at the counter electromotive voltage-generating terminal of the primary winding TFa of the oscillation transformer TF is rectified by the rectifying diode D3 connected to this terminal, and the electrolytic capacitor C3 is connected to the filtering resistor R6 to constitute a smoothing filter, spike noise and the like during oscillation are decreased. As a result, supply of an overvoltage to the flash light-emitting control section is prevented, and other adverse effects to the circuit, e.g., malfunctions are decreased.

According to an electronic flash device according to the second embodiment of the present invention, in the rise operation in which the IGBT is turned on, a light-emission start voltage is supplied to the gate of the IGBT from a drive signal source through a second resistor and a capacitor, and when the capacitor is charged, the light-emitting start voltage is supplied through a first resistor. In the fall operation in which the IGBT is turned off, the charge in the capacitor is output through a third resistor and the second resistor to apply a counter bias to the gate of the IGBT, thus discharging the stray capacitance across the gate and emitter of the IGBT.

As a result, the ON/OFF timings of the IGBT are not delayed with respect to a light-emitting control signal, and the control characteristic of flash light emission of the flash discharge tube is improved.

The electronic flash device according to the second embodiment of the present invention will be described in detail with reference to the accompanying drawings.

Figure 4:
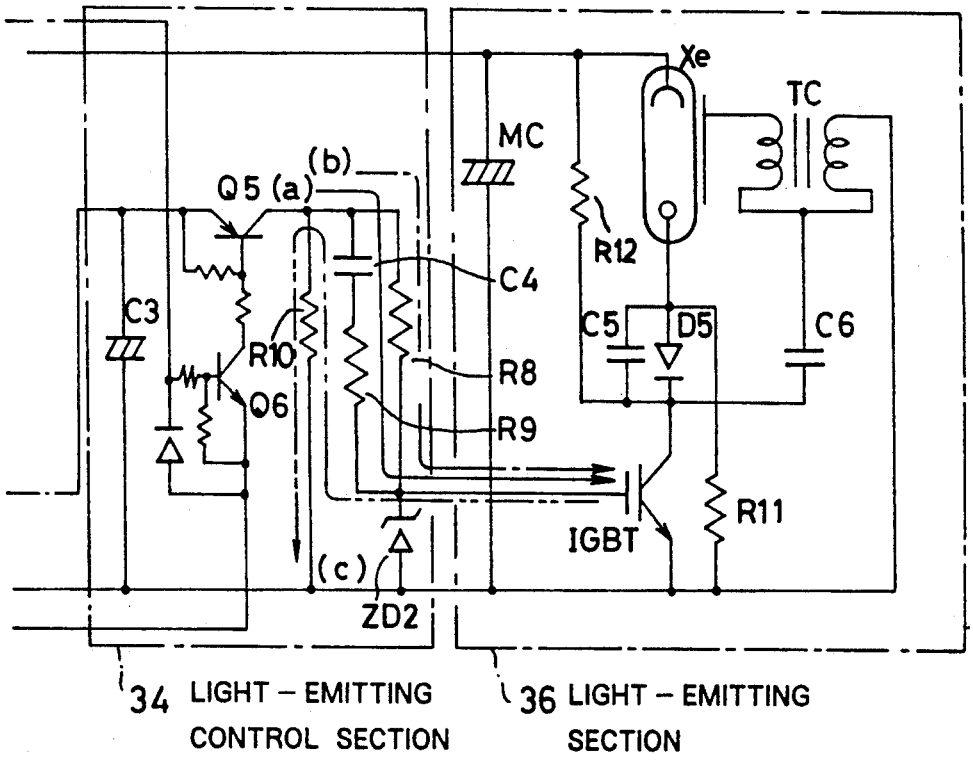
FIG. 4 is a circuit diagram for explaining the operations of a light-emitting control section and a light-emitting section of an electronic flash device according to the second embodiment of the present invention.

FIG. 4 is a circuit diagram for explaining the operation of a light-emitting control section and a light-emitting section of the electronic flash device according to the second embodiment of the present invention.

Figure 5:
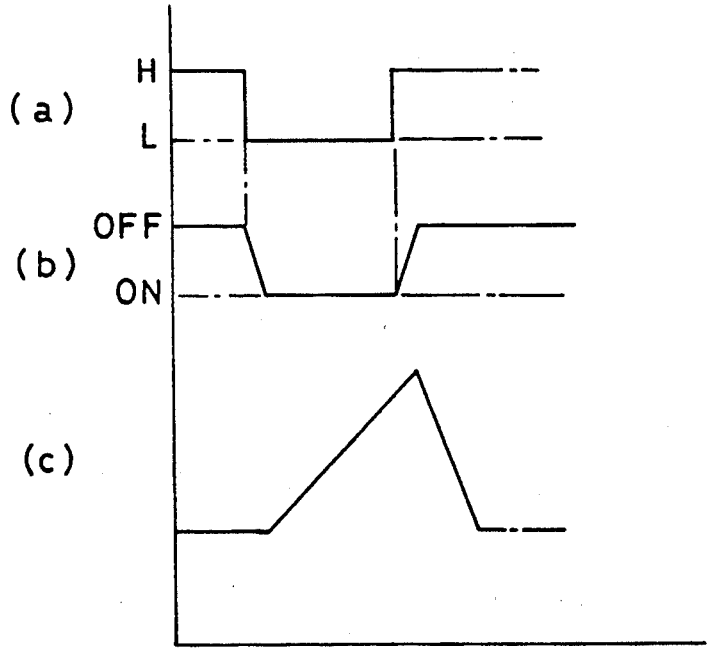
FIG. 5(*a*) to 5(*c*) are timing charts of a processing signal and light emission for explaining the operation of the electronic flash device according to the second embodiment of the present invention.
Figure 6:
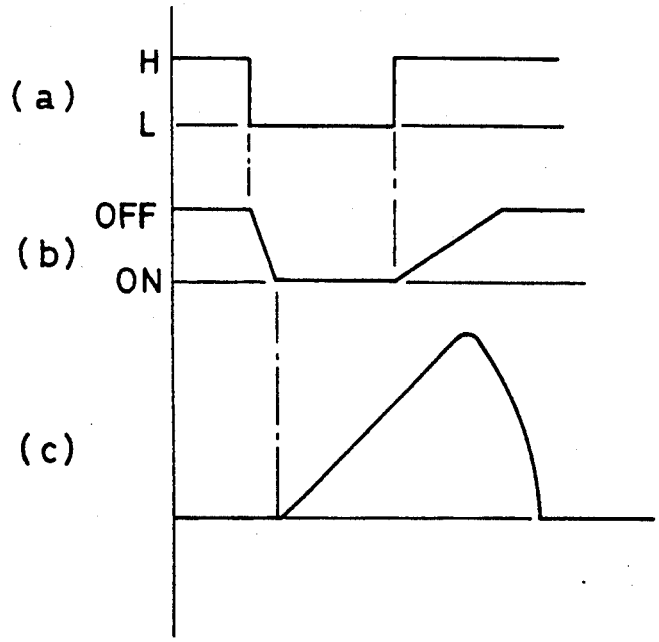
FIG. 6(*a*) to 6(*c*) are timing charts of a processing signal and light emission for explaining the operation of a conventional electronic flash device.

FIGS. 5(*a*) to 5(*c*) are timing charts of a processing signal and light emission for explaining the operation of the electronic flash device according to the second embodiment of the present invention.

Charge of an electrolytic capacitor C3 is completed, and a trigger line TRG is enabled, as shown in FIG. 5(*a*). The voltage charged in the electrolytic capacitor C3 is output through the collector of a switching transistor Q5. This output is supplied to the gate of an IGBT (indicated by a solid line (a) in FIG. 4) through a capacitor C4 and a resistor R9. Subsequently, when charge of a capacitor C4 is completed, the voltage output from the capacitor C4 is applied to the gate of the IGBT through a power supply resistor R8 (indicated by an alternate long and short dashed line (b) in FIG. 4). In this manner, since the base drive voltage is initially applied to the gate of the IGBT through the resistor R9 having a low resistance than that of the power supply resistor R8, as shown in FIG. 5(b), the ON timing of the IGBT is advanced.

When the trigger line TRG is turned off, as shown in FIG. 5(*a*), since the charge in the capacitor C4 is discharged through the resistor R9 and a resistor R10 (indicated by an alternate long and two short dashed line (c) in FIG. 4), a counter bias is generated at the gate of the IGBT and the charge in the floating capacitance across the gate and emitter of the IGBT is quickly discharged. Thus, the fall operation timing of the IGBT with respect to a light-emitting control signal is not delayed, and the quantity of light becomes as shown in FIG. 5(*c*).

The electronic flash device can be applied to an exposure device of an IC manufacturing process and a light source of a phototypesetting machine in addition to a camera.

As has been described above, according to the electronic flash device of the present invention, since the gate drive voltage for the IGBT which is connected to a flash discharge tube to control light emission is obtained from the counter electromotive voltage at a terminal of a primary winding of an oscillation transformer of a DC-DC converter which generates an AC voltage from an input DC voltage, the arrangement is simplified, the size of the oscillation transformer is reduced, and the IGBT can be stably controlled.

According to the electronic flash device of the second embodiment of the present invention, in the rise operation in which the IGBT is turned on, the light-emitting start voltage is supplied from the drive signal supply to the gate of the IGBT through the second resistor and capacitor, and after this capacitor is charged, the light-emitting start voltage is supplied through the first resistor. In the fall operation in which the IGBT is turned off, the charge in the capacitor flows through the third and second resistors to apply a counter bias to the gate of the IGBT, thus discharging the charge of the stray capacitance across the gate and emitter of the IGBT. As a result, the ON/OFF timings of the IGBT against a light-emitting control signal are not delayed, and a control characteristic of flash light emission of the flash discharge tube is improved.

What is claimed is:

1. An electronic flash device comprising:

a flash discharge tube;

an IGBT, connected to said flash discharge tube, for controlling light emission;

trigger means for driving said flash discharge tube;

AC voltage generating means having an oscillation transformer for generating an AC voltage from an input voltage; and a power supply section for generating a gate drive voltage for said IGBT from a counter electromotive voltage generated at a terminal of a winding of said oscillation transformer.

2. A device according to claim 1, wherein said power supply section has at least a rectifying element having one terminal connected to a terminal of a primary winding of said oscillation transformer and a capacitor connected to an output terminal of said rectifying element.

3. A device according to claim 1, further comprising:

IGBT drive voltage generating means for generating the drive voltage for said IGBT;

a first resistor connected between said IGBT drive voltage generating means and a gate of said IGBT;

a capacitor having a terminal connected to said IGBT drive voltage generating means and having a capacitance larger than an electrostatic capacitance across said gate and an emitter of said IGBT;

a second resistor having a terminal connected to the other terminal of said capacitor and the other terminal connected to said gate of said IGBT and a resistance smaller than that of said first resistor; and a third resistor connected between a ground terminal and a connection terminal between said IGBT drive voltage generating means and said first resistor.

* * * * *